United States Patent [19]

Wiese

[11] Patent Number: 4,841,595

[45] Date of Patent: Jun. 27, 1989

[54] VACUUM PUMP-OUT SYSTEM FOR WET/DRY VACUUM CLEANER

[75] Inventor: Martin Wiese, South Bend, Ind.

[73] Assignee: The Kent Company, Ind.

[21] Appl. No.: 82,532

[22] Filed: Aug. 7, 1987

[51] Int. Cl.[4] ..... A47L 7/00

[52] U.S. Cl. ..... 15/352; 15/353; 55/417; 137/205

[58] Field of Search ..... 15/352, 353; 137/205, 137/209, 625.46, 876; 417/149; 55/413, 415, 417

[56] References Cited

U.S. PATENT DOCUMENTS

| | | | |
|---|---|---|---|
| 640,349 | 1/1900 | Wright | 417/149 X |
| 2,049,603 | 8/1936 | Dietenberger | 55/417 X |
| 2,623,234 | 12/1952 | Brown | 15/352 X |
| 3,605,786 | 4/1971 | Machin | 55/417 X |
| 3,606,631 | 9/1971 | Vassh et al. | 15/353 X |
| 3,971,400 | 7/1976 | Thompson | 137/205 |
| 4,116,211 | 9/1978 | Richardson | 137/205 |
| 4,171,208 | 10/1979 | Lowder | 15/353 X |
| 4,179,768 | 12/1979 | Sawyer | 15/352 |
| 4,332,041 | 7/1982 | Kristoffersen | 137/205 X |
| 4,463,474 | 8/1984 | Jacobs | 15/353 |
| 4,506,697 | 3/1985 | Marchant | 137/625.46 X |
| 4,553,566 | 11/1985 | Barclay et al. | 137/625.46 X |

*Primary Examiner*—Harvey C. Hornsby
*Assistant Examiner*—Stephen F. Gerrity
*Attorney, Agent, or Firm*—Alfred E. Miller

[57] ABSTRACT

A wet/dry vacuum cleaner which has a rotatable air directional valve and a piping arrangement whereby the air can be either directed into the tank for pumping out a recovered liquid solution or admitted directly to the tank through an internal flapper valve and expelled around the periphery of the vacuum when functioning as a dry vacuum cleaner.

2 Claims, 5 Drawing Sheets

FIG.1
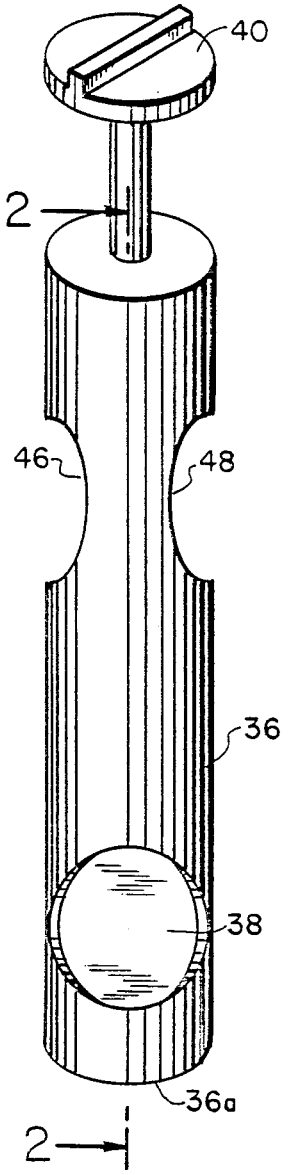
FIG.2
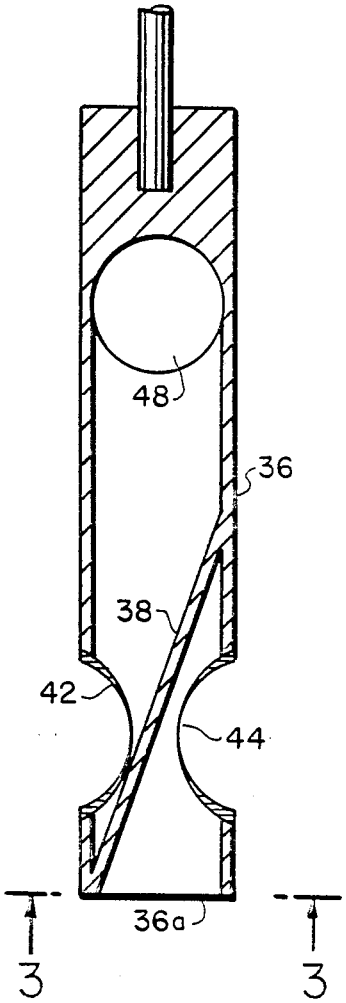
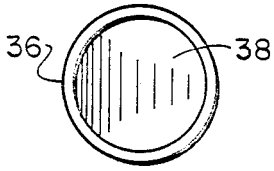
FIG.3

FIG.7
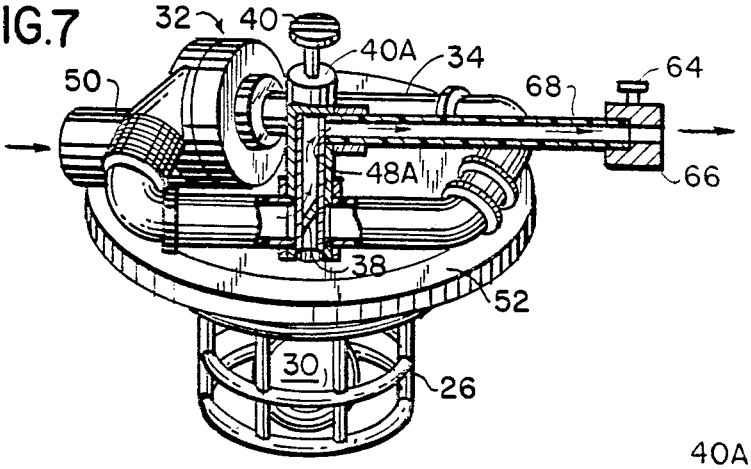
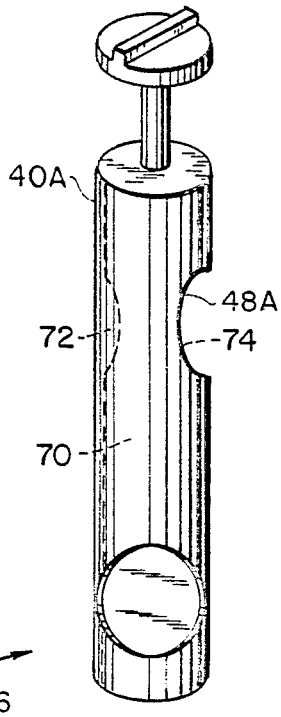
FIG.9
FIG.8
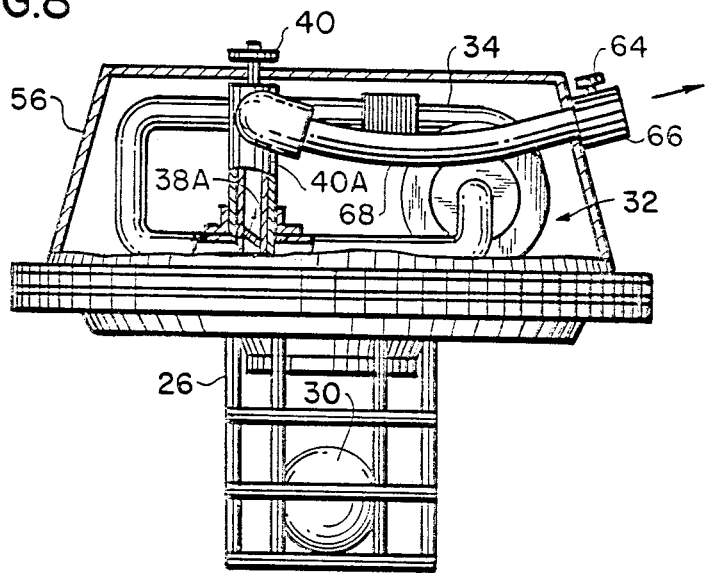

VACUUM PUMP-OUT SYSTEM FOR WET/DRY VACUUM CLEANER

BACKGROUND OF THE INVENTION

Tank type vacuum cleaners for the pick up of dirt as well as liquids are known as wet/dry vacuum cleaners, and which are capable of pumping out the liquid solution in the tank in order to empty the recovered solution. This arrangement is known as vacuum dumping and the recovered liquid or solution is emptied by reversing the air flow of the vacuum motor so that when the liquid solution is recovered in the tank, the exhaust air from the motor can be redirected back into the tank, consequently, pressurizing the solution, pumping it out of a tube inside the tank that extends from the inlet of the tank to the bottom of the tank. Furthermore, this tube is provided with an internal flapper closure so that when the device is used as a vacuum cleaner for dry debris, the dirt or debris comes directly into the tank through the inlet, thereby bypassing the aforementioned tube.

It is an object of the present invention to provide a simplified construction of a wet/dry vacuum cleaner which works effectively in either a suction mode or a liquid dump mode. It is the further object of the present invention to provide a wet/dry vacuum cleaner which includes a rotatable air directional valve in a wet/dry type vacuum apparatus.

It is a further feature of the present invention to provide a unique rotating valve in a piping arrangement whereby air can be either directed into the tank or expelled around the periphery of the vacuum depending on whether or not the device is functioning as a vacuum cleaner, or is pumping out a recovered liquid solution.

It is the further object of the present invention to provide a circular pathway for an air stream ejected from a wet/dry type vacuum cleaner tangential motor, and in which the rotatable air directional valve member is in said circular air path, with the capability of selectively changing the air direction depending on the mode the wet/dry vacuum cleaner device is in.

In order that the present invention will be more clearly understood, it will now be disclosed in greater detail with reference to the accompanying drawings, in which:

FIG. 1 is an enlarged perspective view of the rotatable air directional valve constructed in accordance with the teaching of the present invention.

FIG. 2 is a sectional view of the rotatable air directional valve shown in FIG. 1 taken along the lines 2—2 of FIG. 1.

FIG. 3 is a bottom plan view of the rotatable air directional valve taken along the lines 3—3 of FIG. 3.

FIG. 7 is a partial perspective and a partial sectional view of another embodiment of the present invention in which the exhaust air from the vacuum cleaner assembly can be used as a blower.

FIG. 8 is a view partially in section and partially in elevation of a construction similar to that shown in FIG. 7 but being a modification of the assembly shown in FIG. 6, and FIG. 9 is an enlarged perspective view of the rotatable air valve which is a modification of the valve shown in FIG. 1.

DESCRIPTION OF THE PREFERRED EMBODIMENT

Figure 5:
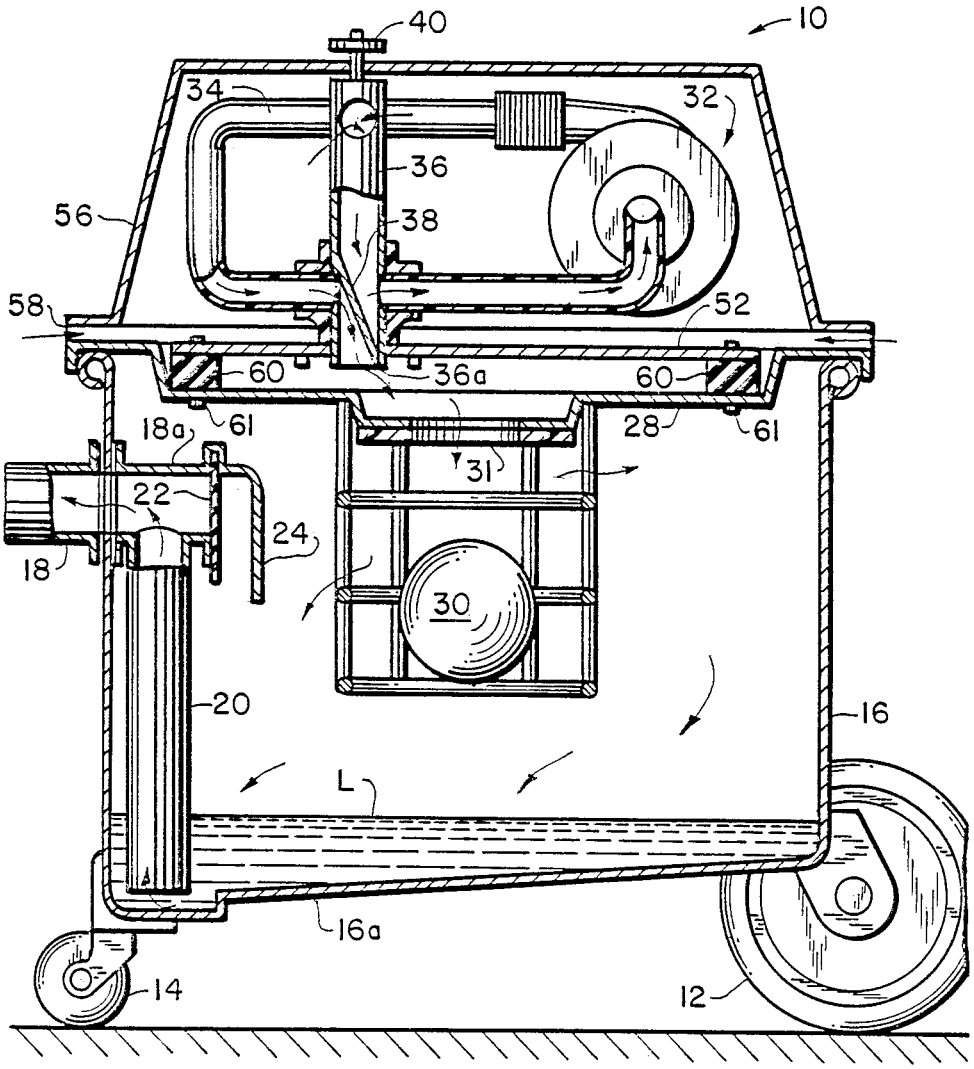
FIG. 5 is a sectional view, partly in elevation, of a wet/dry vacuum assembly in a pumping out solution mode.
Figure 6:
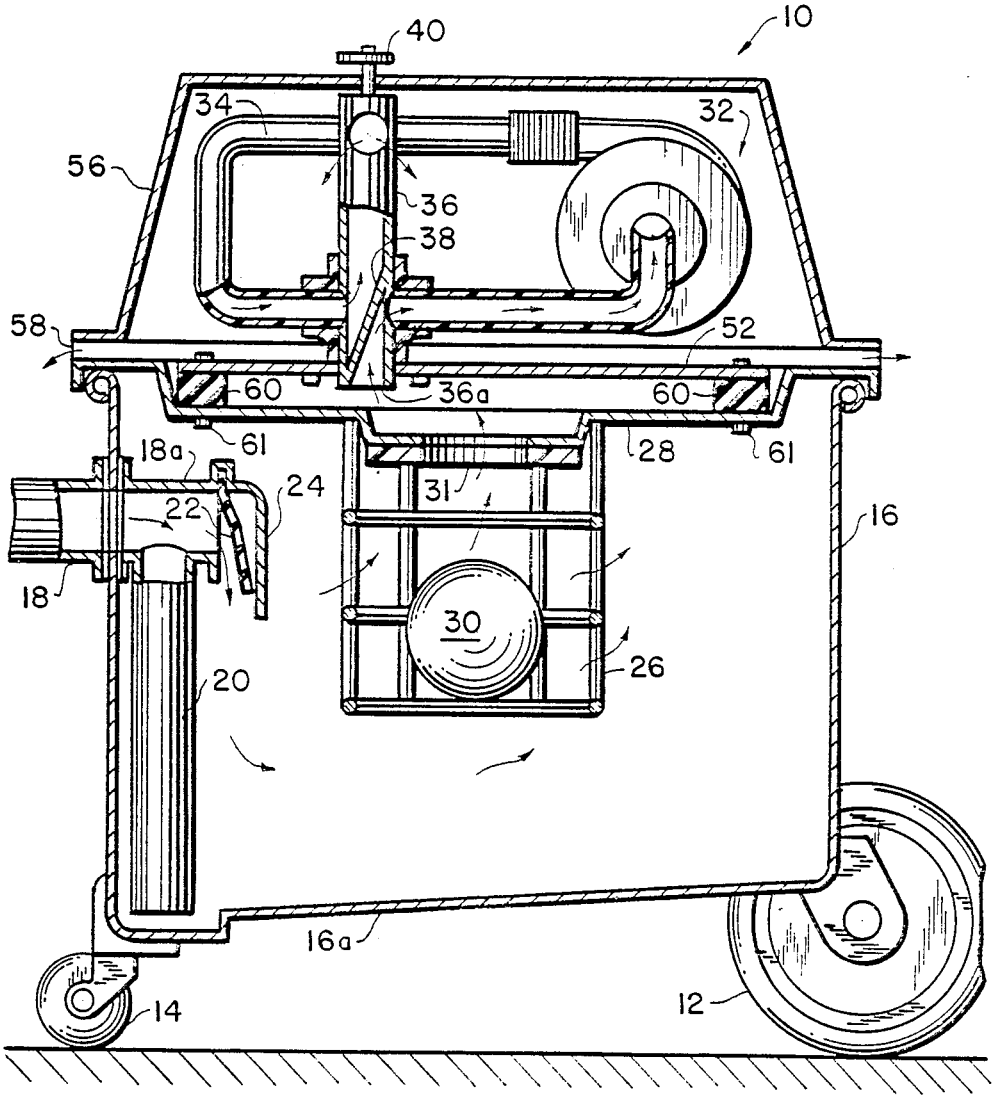
FIG. 6 is a sectional view, partly in elevation, of a wet/dry vacuum cleaner assembly in the vacuum cleaner mode.

As seen in FIGS. 5 and 6, a tank of the wet/dry vacuum cleaner type is shown and is referred to generally by the reference numeral 10, and includes a plurality of wheels 12 and at least one caster 14 for rolling transportation of the device in accordance with my invention to the location where needed.

The dirt, debris and liquid solution tank 16 is carried by said wheels and casters and is provided with an air inlet and liquid outlet tube 18 projecting from one side thereof. Extending vertically within the tank 16 is a pipe 20 that connects with the inlet/outlet by means of a resilient flapper valve 22 that is fixed at one end of the pipe housing 18*a*. Adjacent thereto is a deflector plate 24 for limiting the distance of the opening of the flapper valve 22. It should be observed that the bottom of the tank 16 is sloped downwardly at 16*a* in order to form a sump for collecting liquid which can be pumped out of the system when the vacuum cleaner is in the dump mode. The wire mesh basket 26 is shown supported by the tank support plate 28. The basket is provided with a ball shut-off valve 30 which is adapted to block the opening 31 when the height of the liquid recovered solution in the tank 16 reaches a predetermined level in that tank. Consequently, when this condition occurs, the pumping mode of the vacuum cleaner is automatically shut down.

A tangential vacuum fan motor is supplied to the present wet/dry vacuum cleaner assembly of a known type, such as model 116114-00 Ametek, as shown in the Lamb Electric Division Catalog, dated Sept. 15, 1984.

The tangential vacuum motor is referred to generally by the reference numeral 32 and is provided with piping 34, preferably fabricated of a plastic material and forming a relatively circular pattern for conducting the tangential flow of air from the motor and back through the motor. Within the air conduit a rotatable air directional valve 36 is shown having a baffle plate 38 as well as a knob 40.

Figure 4:
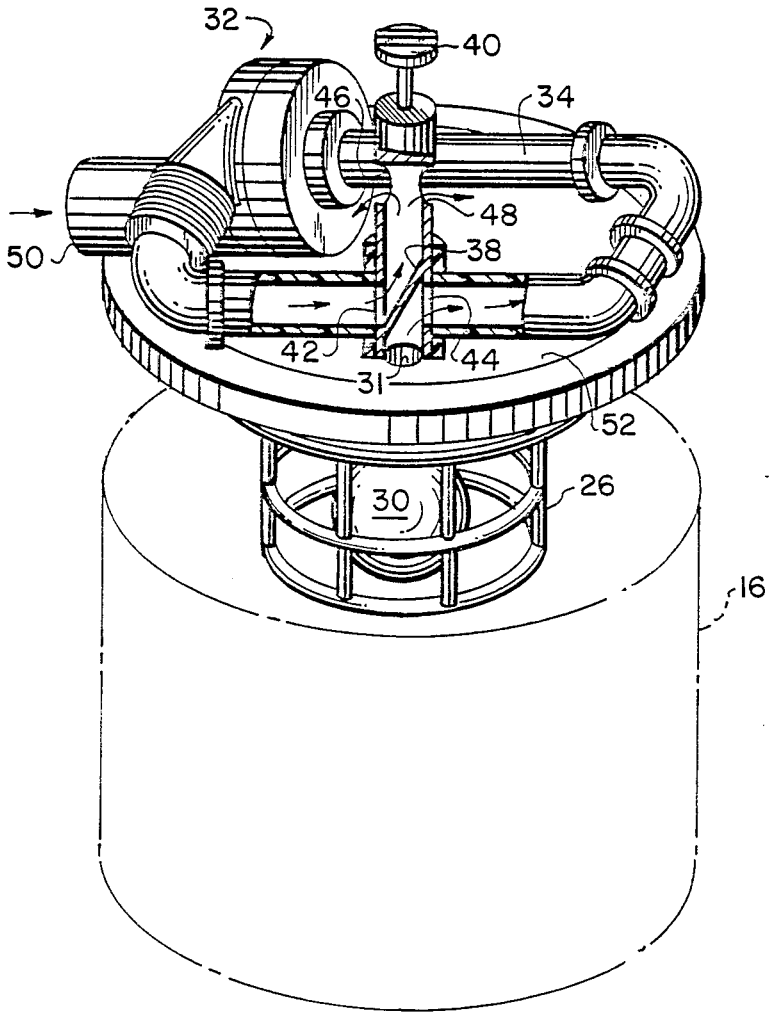
FIG. 4 is a perspective view of the tangential vacuum motor and piping together with the rotating valve of the wet/dry vacuum cleaner assembly.

Referring more particular to FIGS. 1–3, in which the rotatable air directional valve 36 is shown, the openings 42 and 44 in the bottom of the valve and in direct connection with the air flow conduit provide for directing the air flow through the proper channels depending upon whether the wet/dry vacuum cleaner is in the pump-out mode or the vacuum mode. In addition, the openings 46 and 48 in the upper part of the valve function as ports for receiving or discharging air in the valve mechanism. It should be noted that cooling air for the motor enters the pumping arrangement 34 at 50, as shown in FIG. 4.

As seen in FIGS. 5 and 6, the mounting plate 28 for the tangential motor 32, piping 34 and valve 36 are all assembled and secured on mounting plate 52. The mounting plate 52 is spaced from but secured to the tank support plate 28 by means of a gasket 60 and bolt means 61. As seen in FIGS. 5 and 6, the assembly is provided with a cover 56 having an opening 58 between the bottom of the cover and the mounting plate 52.

It should be noted that in the pump-out mode the pressurized air within the tank 16 forces the liquid L present in the tank through the pipe 20 and out of the tank 16 through the inlet/outlet 18. On the other hand, when the apparatus is in the vacuum mode, dirt is sucked into the tank through the inlet/outlet 18, the flap valve 22 which being open against the deflector plate 24, and the dirt-laden air passes through the tank and through the opening 31 in the plate 28 and the opening 36*a* in the bottom of the rotatable valve 36. The air flow continues into the motor 32 and thereafter through the piping system and out the parts 46 and 48 and into the atmosphere through the peripheral opening 58, as is clearly shown in FIG. 5.

FIG. 5 shows the wet/dry vacuum cleaner of the present invention in the pump-out mode in which a quantity of liquid L fell is collected in the bottom of the tank 16. In this mode air is drawn through the peripheral opening 58 between the cover 56 and mounting plate the tanks 52 which passes through ports 46 and 48 of the rotatable valve 36 and enters a piping system 34 and is drawn into the motor 32 and is pressurized. Thereafter, the air is directed by baffle plate 38 through the opening 36*a* in the bottom of the rotatable valve 36, through opening 31 in the plate 28 and into tank 16 which becomes pressurized, forcing the liquid L up pipe 20 and out outlet pipe 18. It should be noted that in this condition, the flap valve 22 is in the closed position so that the only route that the liquid can take is through the open end of pipe 20.

Referring to FIG. 6, the present wet/dry vacuum cleaner is shown in the vacuum mode in which dirt-ladened air which is picked up by a vacuum nozzle (not shown) and passes through inlet pipe 18, pipe 20 and into tank 16. Thereafter, the air flow proceeds through opening 31 in the tank support plate 28 as well as opening 36*a* in the bottom of the rotatable valve 36. The air flow continues into the motor 32 and thereafter through the piping system 34 and out the ports 46 and 48 and into the atmosphere through the peripheral opening 58, all are shown in FIG. 6. It should be noted that in the vacuum mode the flap valve 22 is in an open condition so that the dirt ladened air freely passes through the pipes 18 and 18a and into the interior of the tanks 16.

FIGS. 7, 8 and 9 show an alternative embodiment of the present invention in which the air valve housing 40A is provided with a port 48A on the exhaust side of the valve and additionally has a rotatable internal sleeve 70 provided with a baffle 38A. A conduit, or piping 68 is attached to the port 48A as clearly seen in FIG. 7, and at the free end of the conduit the fitting 66 is provided with a valve operator 64. The internal sleeve 70 has a port 72 which is blocked when the valve is in the position shown in FIG. 7 but is aligned and in communication with the conduit 68 when the valve sleeve 70 is rotated to the position shown in FIG. 8. It is obvious that a hose or a nozzle can be attached to the fitting 66 (not shown) so that the air expelled from the vacuum cleaner can be utilized as a blower with the proper hose and nozzle attached to the fitting 66. As seen in FIG. 8, the fan motor assembly is encased by a cover 56 and the conduit 66 receives atmospheric air in the direction of the arrow which moves through the piping system 34 in a manner shown in FIG. 5 during the pumpout mode of the vacuum cleaner.

It is to be noted that the rotatable valve 36, when utilized in the pumpout mode, can be either rotated to the full open position, or can be only partially rotated. In the latter case, the rotation of the valve to a partial opening will bleed off some of the exhaust air, consequently reducing pressure resulting in reducing the blowing action or exhaust of the water from the recovery tank. This function can be advantageously used in connection with a large wet/dry vacuum cleaner which has a great deal of solution to be dumped into a small drain consequently permitting complete control of the flow rate in the pumpout mode of the vacuum cleaner.

While the invention has been disclosed and described herein with reference to a single embodiment, it is apparent that variations and modifications may be made which fall within the true spirit and scope of the invention as defined in the following claims.

What is claimed is:

1. In a wet/dry vacuum cleaner device having a suction mode and a fluid pressurizing mode resulting in air and liquid discharge respectively, a tank provided with an inlet/outlet aperture, an automatic float type shut-off means in said tank being operative when said liquid rises to a predetermined level in said tank, the improvement comprising a tangential fan motor, piping connected to said motor and said tank to form a circuit, a cover on said tank substantially enclosing said motor and associated piping, an opening from the interior of said cover to said atmosphere, and a hollow rotary valve connected substantially at right angles to said piping and having a knob control extending through the top surface of said cover, said valve having a cylindrical body with an upper port and a lower port therein, an inner sleeve rotatable within said cylindrical body, a baffle plate being fixedly secured to opposite sides of the inner wall of said inner sleeve, said inner sleeve having spaced openings whereby in different predetermined positions of said baffle plate said ports and openings are aligned in communication with said piping, and said lower port communicating with said piping while said upper port communicates with the interior of said cover whereby when said inner sleeve of said rotary valve is turned to one position air is drawn into the interior of said cover from said atmosphere through said opening and passes through said upper port and piping to be pressurized by said fan motor and directed by said baffle through said lower port and into said tank whereby the liquid in said tank is forced out said inlet/outlet aperture, and when said inner sleeve of said rotary valve is turned with the baffle in another position, dirt-laden air is drawn into said tank through said inlet/outlet aperture and lower port and is directed by said baffle plate to said fan-motor and piping and out said upper port and is discharged to said atmosphere through said opening.

2. A wet/dry vacuum cleaner device as claimed in claim 1 wherein when said device is in a suction mode said inner sleeve of said rotary valve can be rotated to a position which is less than the full open position thereby adjusting the amount of air being discharged out of said opening.

* * * * *